US009781509B2

(12) United States Patent
Tawada

(10) Patent No.: US 9,781,509 B2
(45) Date of Patent: Oct. 3, 2017

(54) SIGNAL PROCESSING APPARATUS AND SIGNAL PROCESSING METHOD

(71) Applicant: CANON KABUSHIKI KAISHA, Tokyo (JP)

(72) Inventor: Noriaki Tawada, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/811,387

(22) Filed: Jul. 28, 2015

(65) Prior Publication Data

US 2016/0044411 A1 Feb. 11, 2016

(30) Foreign Application Priority Data

Aug. 5, 2014 (JP) ..... 2014-159761

(51) Int. Cl.
*H04R 3/00* (2006.01)

(52) U.S. Cl.
CPC ..... *H04R 3/005* (2013.01); *H04R 2410/05* (2013.01)

(58) Field of Classification Search
CPC ..... H04R 2410/01; H04R 2410/05; H04R 2203/12; H04R 3/005; H04R 3/00
USPC ..... 381/122, 11–113
See application file for complete search history.

(56) References Cited

U.S. PATENT DOCUMENTS 5,130,812 A * 7/1992 Yamaoka ..... G11B 19/06 358/909.1
5,303,304 A * 4/1994 Lee ..... G11B 31/006 348/373
7,119,267 B2 * 10/2006 Hirade ..... G10H 1/08 381/119
7,187,775 B2 * 3/2007 Fujita ..... H04R 5/04 381/11
8,150,061 B2 * 4/2012 Ozawa ..... H04S 7/30 348/333.02
8,532,308 B2 9/2013 Tawada
9,134,167 B2 9/2015 Tawada
2007/0242839 A1 * 10/2007 Kim ..... H04R 3/00 381/122

(Continued)

FOREIGN PATENT DOCUMENTS

JP 2010-278918 A 12/2010
JP 2011-199474 A 10/2011

*Primary Examiner* — Disler Paul

(74) *Attorney, Agent, or Firm* — Fitzpatrick, Cella, Harper & Scinto

(57) ABSTRACT

A signal processing apparatus acquires an audio signal of channels using a sound acquisition unit, at least a part of which is within a housing of the apparatus, and obtains an audio signal of channels from a microphone provided outside the housing. The apparatus processes an audio signal in accordance with a first propagation characteristic indicating propagation of sound associated with a direction of a sound source, in a case of processing an audio signal acquired by the sound acquisition unit and processes an audio signal in accordance with a second propagation characteristic different from the first propagation characteristic, in a case of processing an audio signal obtained by the microphone. The signal processing apparatus estimates a sound source direction using an audio signal processed by the first processing unit or an audio signal processed by the second processing unit.

22 Claims, 10 Drawing Sheets

(56) References Cited

U.S. PATENT DOCUMENTS

| | | | | |
|---|---|---|---|---|
| 2008/0013748 | A1* | 1/2008 | Yang | H04M 1/026 381/92 |
| 2013/0044901 | A1* | 2/2013 | Dong | H04R 3/005 381/122 |
| 2013/0226593 | A1* | 8/2013 | Magnusson | H04N 5/765 704/276 |
| 2013/0275873 | A1* | 10/2013 | Shaw | G01S 3/8006 715/716 |
| 2014/0185826 | A1 | 7/2014 | Tawada | |
| 2014/0211950 | A1* | 7/2014 | Neufeld | H04R 5/04 381/23 |
| 2015/0010158 | A1* | 1/2015 | Broadley | H04R 29/00 381/58 |
| 2015/0139446 | A1 | 5/2015 | Tawada | |
| 2015/0230026 | A1* | 8/2015 | Eichfeld | H04R 5/027 381/26 |

* cited by examiner

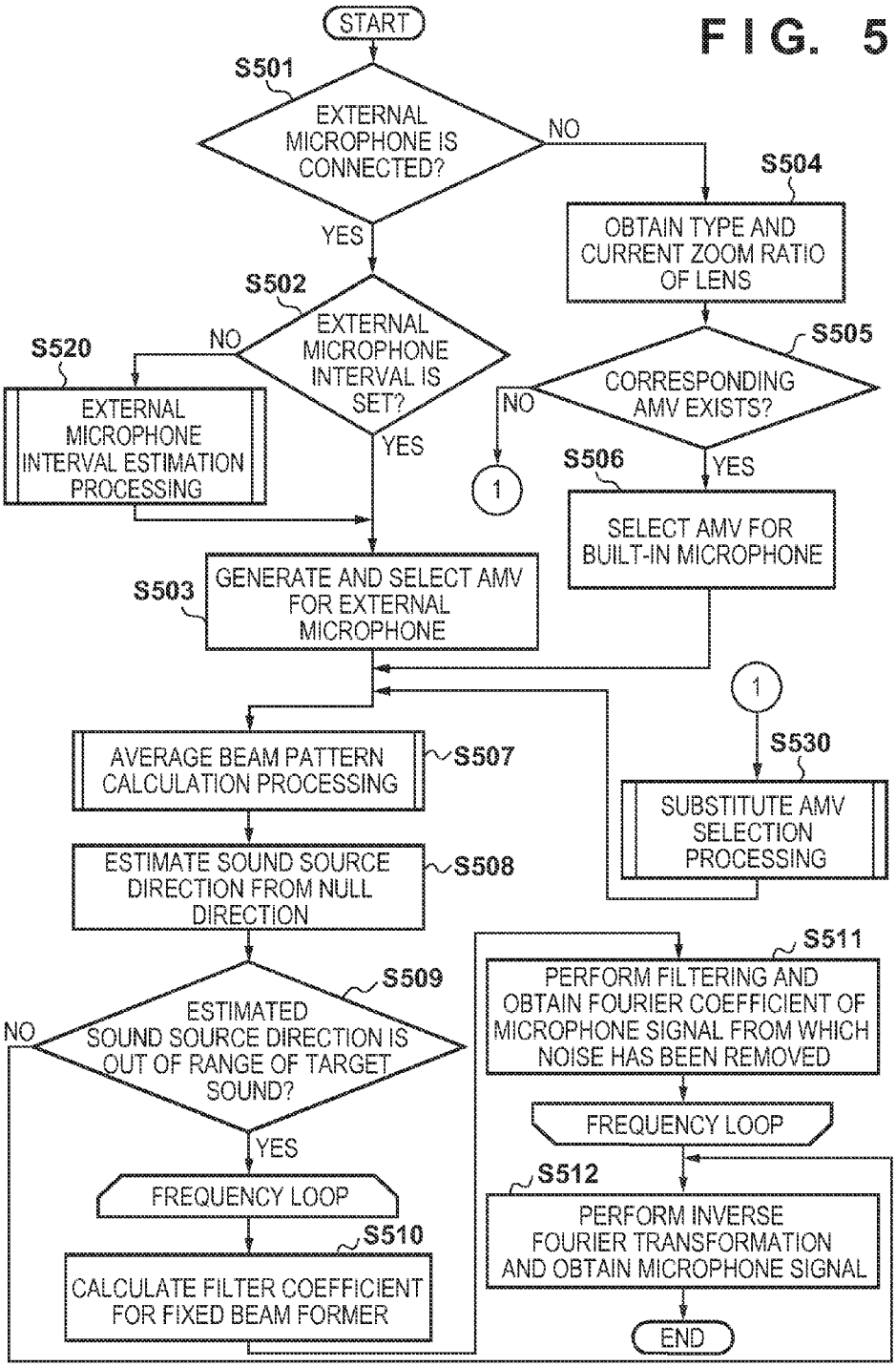
FIG. 5
START
S501
EXTERNAL MICROPHONE IS CONNECTED?
NO
YES
S504
OBTAIN TYPE AND CURRENT ZOOM RATIO OF LENS
S502
EXTERNAL MICROPHONE INTERVAL IS SET?
NO
S520
EXTERNAL MICROPHONE INTERVAL ESTIMATION PROCESSING
YES
S505
CORRESPONDING AMV EXISTS?
NO
1
YES
S506
SELECT AMV FOR BUILT-IN MICROPHONE
S503
GENERATE AND SELECT AMV FOR EXTERNAL MICROPHONE
1
S530
SUBSTITUTE AMV SELECTION PROCESSING
AVERAGE BEAM PATTERN CALCULATION PROCESSING
S507
ESTIMATE SOUND SOURCE DIRECTION FROM NULL DIRECTION
S508
S509
ESTIMATED SOUND SOURCE DIRECTION IS OUT OF RANGE OF TARGET SOUND?
NO
YES
FREQUENCY LOOP
S510
CALCULATE FILTER COEFFICIENT FOR FIXED BEAM FORMER
S511
PERFORM FILTERING AND OBTAIN FOURIER COEFFICIENT OF MICROPHONE SIGNAL FROM WHICH NOISE HAS BEEN REMOVED
FREQUENCY LOOP
S512
PERFORM INVERSE FOURIER TRANSFORMATION AND OBTAIN MICROPHONE SIGNAL
END

SIGNAL PROCESSING APPARATUS AND SIGNAL PROCESSING METHOD

BACKGROUND OF THE INVENTION

Field of the Invention

The present invention relates to signal processing apparatuses that perform audio processing, and signal processing methods.

Description of the Related Art

A technique of removing unnecessary noise from an audio signal is important for improving audibility to target sound included in the audio signal and increasing the recognition rate in speech recognition. Representative techniques of removing noise in an audio signal include a beamformer. This is for adding microphone signals of a plurality of channels acquired by a plurality of microphone elements after filtering each microphone signal, and obtaining a single output signal. The aforementioned filtering and addition processing corresponds to formation of a spatial beam pattern having a directivity, i.e., a direction-selectivity characteristic, using a plurality of microphone elements, and is therefore called the beamformer.

A portion at which sensitivity (gain) of a beam pattern reaches its peak is called a main lobe, and it is possible to emphasize target sound and simultaneously suppress noise existing in a direction different from the direction of the target sound by configuring the beamformer such that the main lobe is oriented to the direction of the target sound. However, the main lobe of a beam pattern forms a gentle curve having a wide width particularly in the case where the number of microphone elements is small. For this reason, even if such a main lobe of a beam pattern is oriented to the direction of the target sound, noise that is close to the target sound cannot be sufficiently removed.

In this regard, a noise removal method using not the main lobe but a null (dead angle), which is a portion at which the sensitivity of a beam pattern reaches its dip, has been proposed. That is to say, only noise can be sufficiently removed by orienting a sharp null to the direction of noise, without losing target sound whose direction is close to the noise direction. A beamformer that thus forms a null in a specific direction in a fixed manner is called a fixed beamformer. Here, if the direction to which the null is oriented is not accurate, noise removing performance significantly deteriorates, and accordingly estimation of the direction of a sound source is important.

In contrast with the fixed beamformer, a beamformer by which the null of a beam pattern is automatically formed is called an adaptive beamformer, and the adaptive beamformer can be used to estimate the sound source direction. Considering target sound and noise as directional sound sources whose power spatially concentrates on one point, a filter coefficient with which the null is automatically formed in the sound source direction can be obtained using the adaptive beamformer that is based on a rule that minimizes output power. Accordingly, in order to find the sound source direction, a beam pattern formed by a filter coefficient of the adaptive beamformer is calculated, and the null direction thereof need only be obtained. The beam pattern can be calculated by multiplying a filter coefficient by a transfer function called an array manifold vector between a sound source in each direction and each microphone element. For example, the angle of the direction in which the filter coefficient has a null that is a dip of the sensitivity is checked using array manifold vectors in −180° to 180° directions at 1° intervals.

Here, in sound source separation such as that performed using the beamformer, in general, an array manifold vector using a theoretical formula in a free field is often used, assuming that a microphone is arranged in a free field. Sound ideally propagates in a free field where there is no obstruction, and accordingly, for example, a difference in propagation delay time between microphone elements, i.e., a phase difference at each frequency between array manifold vector elements is geometrically obtained by a theoretical formula with a microphone interval as a parameter. In contrast, in the case where a microphone is arranged not in a free field but in the vicinity of a housing or therewithin, diffraction, blocking, scattering, or the like of sound occurs due to the housing, and accordingly the aforementioned phase difference diverges from the theoretical value in a free field. Furthermore, a difference in signal amplitude between microphone elements in each sound source direction is also affected by the housing in which the microphone elements are arranged.

Since the amplitude difference and the phase difference between the microphone elements significantly change due to the influence of the housing in which the microphones are arranged as mentioned above, the array manifold vector, which is a transfer function between a sound source in each direction and each microphone element, also changes due to the influence of the housing. If the array manifold vector used to calculate a beam pattern does not follow such a change, the sound source direction cannot be accurately estimated. Japanese Patent Laid-Open No. 2011-199474 (hereinafter, Document 1) describes estimation of an array manifold vector that contains the influence of a housing, using independent component analysis. Japanese Patent Laid-Open No. 2010-278918 (hereinafter, Document 2) describes sequentially obtaining microphone position coordinates that change in accordance with an open/close state of a housing movable portion and using the microphone position coordinates as parameters in sound source separation processing, in the case where a microphone is attached to the housing movable portion of a foldable mobile phone or the like.

However, there are cases where the accuracy of the sound source estimation cannot yet be maintained with the methods described in Documents 1 and 2. With the method in Document 1, for example, in the case of using a built-in microphone in a camcorder, it is conceivable that an array manifold vector which contains the influence of the housing of the camcorder can be estimated and used. However, in the case of switching the microphone used to obtain the audio signal from the built-in microphone to an external microphone, the external microphone is separate from the camcorder and is therefore not easily affected by the housing of the camcorder. That is to say, the array manifold vector significantly changes between the built-in microphone and the external microphone. In Document 1, selection of the array manifold vector while assuming such a case where the microphone is switched is not at all considered.

Regarding the method in Document 2, since the microphone position coordinates are parameters in the sound source separation processing, it is conceivable that a free field is assumed. However, in actual audio processing in a camcorder or the like, the array manifold vector used in the audio processing is affected by diffraction or the like caused by a housing. Furthermore, even if the microphone position coordinates do not change, if the shape of the housing changes due to interchange or zooming of a lens of the camcorder, for example, it is conceivable that the array manifold vector also changes accordingly. However, in Document 2, selection of the array manifold vector while taking such influence of a change of the housing shape on diffraction or the like into account is not considered.

SUMMARY OF THE INVENTION

According to an embodiment of the present invention, a signal processing apparatus and a signal processing method are provided that achieve highly accurate audio processing.

According to one aspect of the present invention, there is provided a signal processing apparatus that processes an audio signal comprising: a sound acquisition unit configured to acquire an audio signal of a plurality of channels, at least a part of the sound acquisition unit being within a housing of the signal processing apparatus; an obtaining unit configured to obtain an audio signal of a plurality of channels from a microphone provided outside the housing of the signal processing apparatus; a first processing unit configured to process an audio signal in accordance with a first propagation characteristic indicating propagation of sound associated with a direction of a sound source, in a case of processing an audio signal acquired by the sound acquisition unit; a second processing unit configured to process an audio signal in accordance with a second propagation characteristic different from the first propagation characteristic, in a case of processing an audio signal obtained by the obtaining unit; and an estimation unit configured to estimate a sound source direction using an audio signal processed by the first processing unit or an audio signal processed by the second processing unit.

According to another aspect of the present invention, there is provided a signal processing apparatus that processes an audio signal comprising: a sound acquisition unit configured to acquire an audio signal of a plurality of channels, at least a part of the sound acquisition unit being within a housing of the signal processing apparatus; a determination unit configured to determine a shape of the housing; a first obtaining unit configured to obtain a propagation characteristic of sound associated with a direction of a sound source in accordance with the shape of the housing determined by the determination unit; a processing unit configured to process an audio signal acquired by the sound acquisition unit in accordance with a propagation characteristic obtained by the first obtaining unit; and an estimation unit configured to estimate a sound source direction using an audio signal processed by the processing unit.

According to another aspect of the present invention, there is provided a signal processing method for processing an audio signal comprising: a sound acquiring step of acquiring an audio signal of a plurality of channels using a sound acquisition unit, at least a part of the sound acquiring unit being within a housing of the signal processing apparatus; an obtaining step of obtaining an audio signal of a plurality of channels from a microphone provided outside the housing of the signal processing apparatus; a first processing step of processing an audio signal in accordance with a first propagation characteristic indicating propagation of sound associated with a direction of a sound source, in a case of processing an audio signal acquired in the sound acquiring step; a second processing step of processing an audio signal in accordance with a second propagation characteristic different from the first propagation characteristic, in a case of processing an audio signal obtained in the obtaining step; and an estimation step of estimating a sound source direction using an audio signal processed in the first processing step or an audio signal processed in the second processing step.

According to another aspect of the present invention, there is provided a signal processing method for processing an audio signal comprising: a sound acquiring step of acquiring an audio signal of a plurality of channels using a sound acquisition unit, at least a part of the sound acquiring unit being within a housing of a signal processing apparatus; a determination step of determining a shape of the housing; an obtaining step of obtaining a propagation characteristic of sound associated with a direction of a sound source in accordance with the shape of the housing determined in the determination step; a processing step of processing an audio signal acquired in the sound acquiring step in accordance with a propagation characteristic obtained in the obtaining step; and an estimation step of estimating a sound source direction using an audio signal processed in the processing step.

Further features of the present invention will become apparent from the following description of exemplary embodiments with reference to the attached drawings.

BRIEF DESCRIPTION OF THE DRAWINGS

FIG. 5 is a flowchart illustrating audio processing according to an embodiment.

DESCRIPTION OF THE EMBODIMENTS

Figure 1:
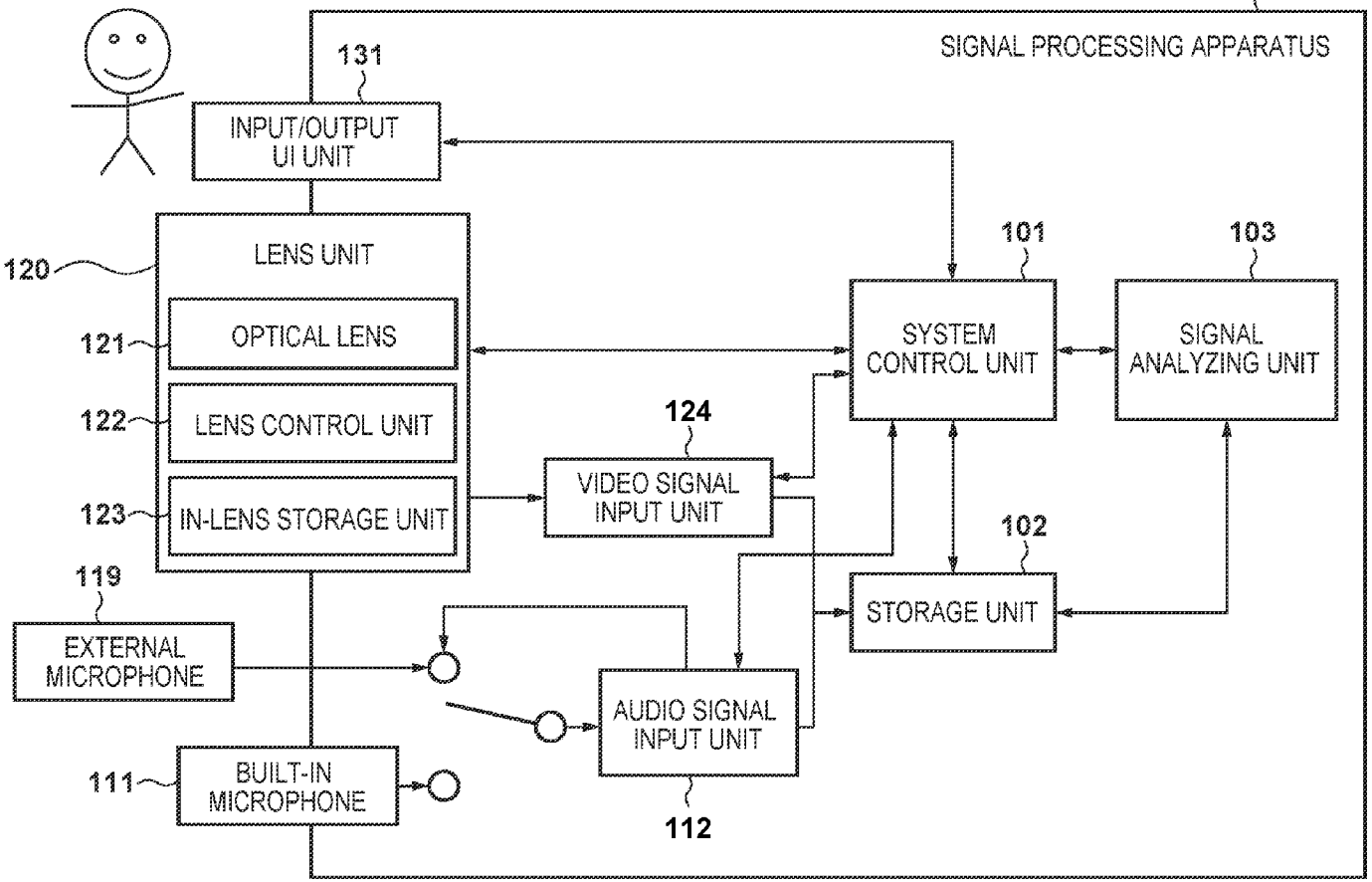
FIG. 1 is a block diagram showing an exemplary configuration of a signal processing apparatus according to an embodiment.

Hereinafter, an exemplary preferable embodiment of the present invention will be described in detail with reference to the attached drawings. Note that configurations and the like described in the following embodiment are merely examples, and the present invention is described in the embodiment and not limited to configurations shown in the drawings. Note that, in the drawings, an array manifold vector indicating a transfer function between a sound source in each direction and each microphone element will be abbreviated as an AMV.

Figure 2A:
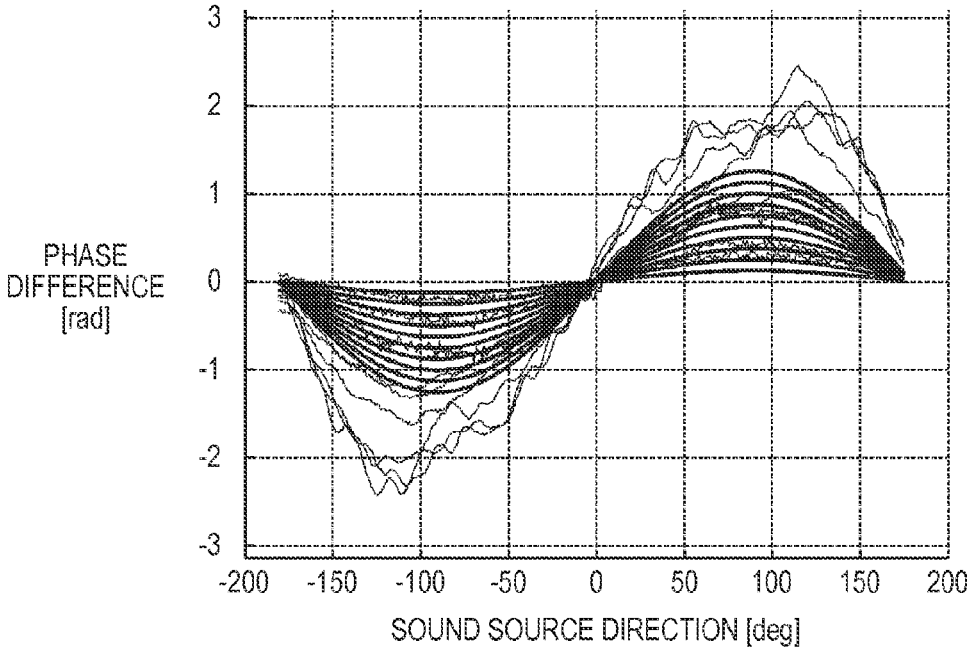
FIGS. 2A and 2B are diagrams illustrating influence that a housing has on an array manifold vector.

First, divergence of a phase difference between microphone elements from a theoretical value thereof due to the influence of a housing will be described with reference to FIGS. 2A and 2B. Thin lines in FIG. 2A indicate, for respective frequencies, phase differences between microphone elements in respective sound source directions when using a camcorder that has two microphone elements as built-in microphones, the phase differences being measured by a traverse apparatus in an anechoic chamber. Here, the front 0°, which is a shooting direction of the camcorder, is in a direction of a perpendicular bisector of a line connecting the two built-in microphone elements. The frequency is displayed at every 187.5 Hz from 187.5 Hz to 1875 Hz, and the phase difference tends to be larger as the frequency is higher. On the other hand, smooth thick lines in FIG. 2A indicate theoretical values in a free field at each frequency using the interval between the aforementioned built-in microphones as a parameter. At each frequency, the phase difference is geometrically largest in the ±90° direction, which is the direction of the line connecting the two microphone elements. Here, comparing the theoretical value with the measured value of the phase difference at the same frequency, it is found that the measured value tends to be larger than the theoretical value in a free field due to the influence of diffraction or the like caused by the housing of the camcorder.

Figure 2B:
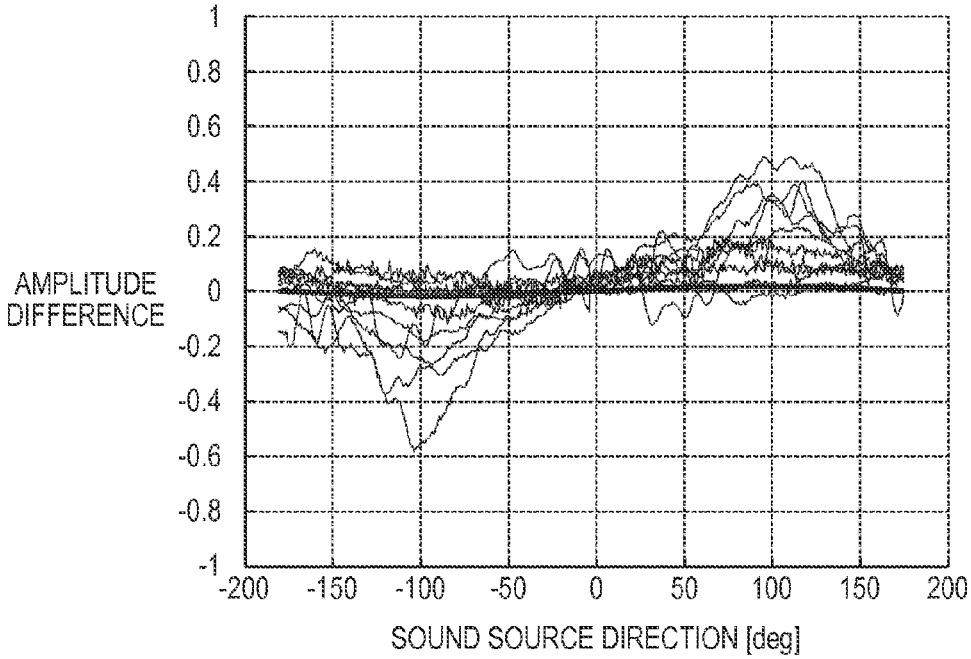

Similarly, thin lines in FIG. 2B indicate, for respective frequencies, measured values of amplitude difference between the microphone elements in respective sound source directions when using the aforementioned camcorder. Here, it is assumed that the amplitude difference is normalized by an amplitude sum, and is in the range from −1 to 1. As in the case of the phase difference, the amplitude difference tends to be larger as the frequency is higher in the vicinity of ±90°, which indicates a lateral direction. On the other hand, a thick line in FIG. 2B indicates theoretical values in a free field regarding which space attenuation based on the inverse-square law is taken into account, and it is found that almost no amplitude difference occurs with a microphone interval of several centimeters. As described above, the amplitude difference and the phase difference between the microphone elements are affected by the housing in which the microphones are arranged, and significantly change.

Figure 3A:
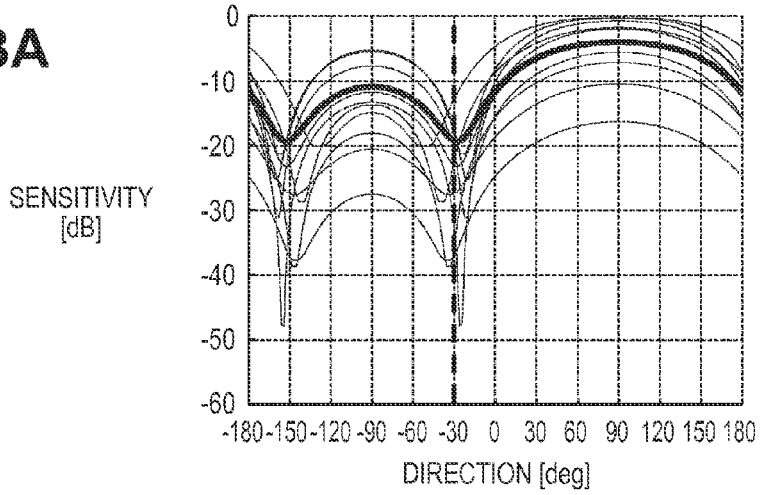
FIGS. 3A to 3C are diagrams illustrating influence that selection of the array manifold vector has on beam patterns.
Figure 3B:
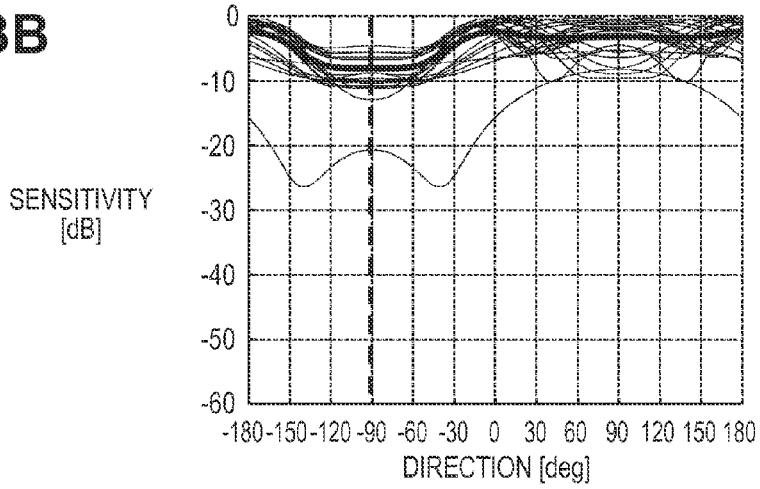
Figure 3C:
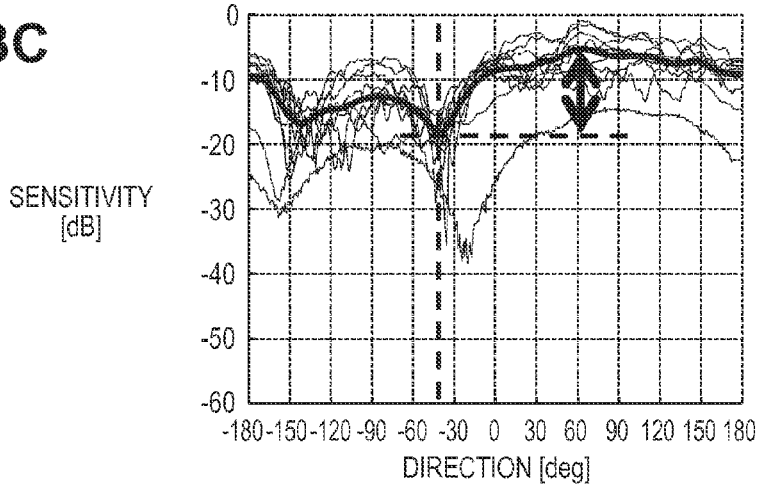

Next, the influence that selection of the array manifold vector has on a beam pattern will be specifically described. FIGS. 3A to 3C show the influence that selection of the array manifold vector used to calculate a beam pattern of the adaptive beamformer has on the beam pattern and sound source direction estimation. Here, beam patterns are obtained at respective frequencies, and thin lines in FIGS. 3A to 3C display, as a part of these beam patterns, beam patterns from 750 Hz to 7500 Hz at every 750 Hz. Thick lines in FIGS. 3A to 3C display average beam patterns, which are obtained by averaging the beam patterns at respective frequencies.

In FIG. 3A, a sound source is arranged in the −30° direction, an audio signal is obtained using microphones arranged in a free field to calculate a filter coefficient of the adaptive beamformer, and beam patterns thereof are calculated and displayed. Here, an array manifold vector generated by a theoretical formula in a free field with a microphone interval as a parameter is used. This is equivalent to selecting and using an array manifold vector corresponding to a state at the time of obtaining the audio signal with the microphones arranged in a free field. As a result, as indicated by the thick line in FIG. 3A, an average beam pattern in which a null is formed in the −30° direction, which is the sound source direction, is obtained, and the sound source direction can be accurately found from the null direction of the average beam pattern indicated by a vertical dotted line in FIG. 3A. Note that a beam pattern from −90° to 90° through 0° and a beam pattern from −90° to 90° through ±180° are symmetric.

On the other hand, in FIGS. 3B and 3C, a sound source is arranged in the −40° direction, the audio signal is obtained using the built-in microphones in the camcorder to calculate a filter coefficient of the adaptive beamformer, and beam patterns thereof are calculated and displayed. In FIG. 3B, an array manifold vector is used that is generated using a theoretical formula in a free field with the interval between these built-in microphones as a parameter. This situation means that an array manifold vector which is different from that corresponding to the state at the time of obtaining the audio signal affected by the housing of the camcorder is selected and used. As a result, for example, the average beam pattern only widely and shallowly recesses around −90° as indicated by the thick line in FIG. 3B, and it is difficult to say that the null is appropriately formed. For this reason, the sound source direction cannot be accurately estimated from the null direction of the average beam pattern.

In FIG. 3C, an array manifold vector measured in an anechoic chamber is used as a transfer function between the sound source in each direction and the built-in microphones in the camcorders. This means that an array manifold vector corresponding to the state at the time of obtaining the audio signal affected by the housing of the camcorder is selected and used. As a result, as indicated by the thick line in FIG. 3C, an average beam pattern is obtained in which the null is formed in the −40° direction, which is the sound source direction, and the sound source direction can be accurately found from the null direction of the average beam pattern indicated by a vertical dotted line in FIG. 3C. Note that if the shape of the housing is roughly symmetric with respect to the shooting direction as in the case of a camcorder, the beam pattern from −90° to 90° through 0° and the beam pattern from −90° to 90° through ±180° are also roughly symmetric.

For these reasons, it can be understood that, in the calculation of a beam pattern of a beamformer, selecting and using an array manifold vector corresponding to the state at the time of obtaining the audio signal is important for estimating the sound source direction from the null of the beam pattern. Here, the state at the time of obtaining the audio signal is affected by the shape of the housing or the like.

Figures 4A, 4B, 4C, 4D, 4E:
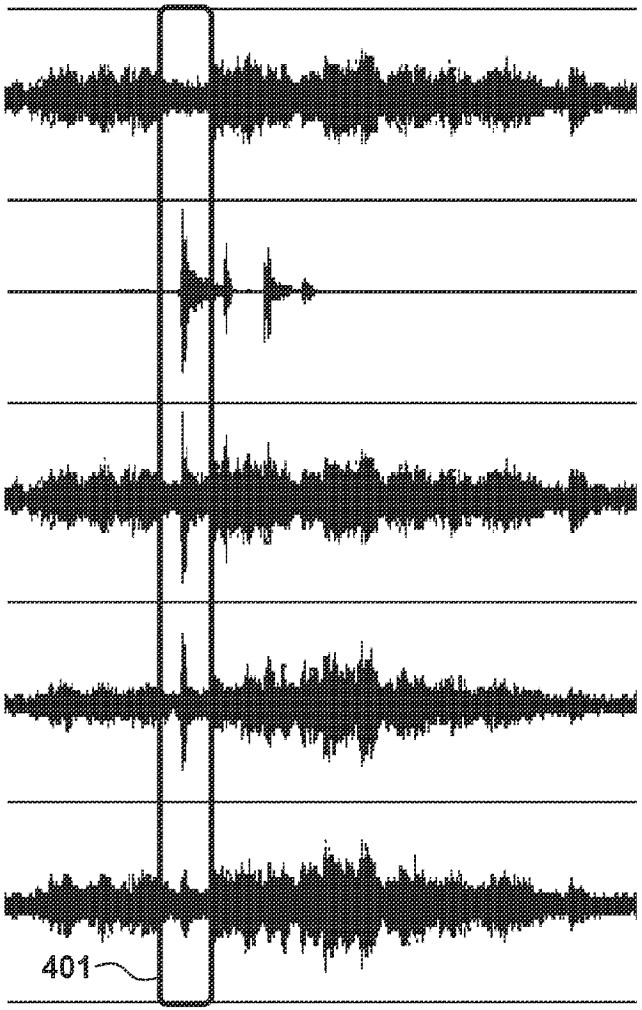
FIGS. 4A to 4E are diagrams illustrating influence that accuracy of estimation of a sound source direction has on noise removing performance.

FIGS. 4A to 4E are diagrams further showing the influence that the selection of the array manifold vector and the accuracy of the estimation of the sound source direction have on the noise removing performance. For example, consider the case where, when filming a piano recital using a camcorder, sound of coughing of an audience, such as the sound shown in FIG. 4B, comes from the −40° direction in addition to sound of the piano in the front direction, such as the sound shown in FIG. 4A. In this case, each channel of the audio signal obtained by the built-in microphones in the camcorder indicates a mixture of the sound of the piano and the sound of the coughing, as shown in FIG. 4C. Now, consider removal of the sound of the coughing, which is noise, from this audio signal.

The sound of the coughing is dominant in a section enclosed by a thick line 401 in FIGS. 4A to 4E. Therefore, if an adaptive beamformer is configured from the audio signal at this time, a filter coefficient with which the null is automatically formed in the direction of the coughing is obtained. Accordingly, the direction of the coughing can be estimated from the null direction by calculating a beam pattern formed by this filter coefficient. However, as mentioned above, if an array manifold vector generated by a theoretical formula in a free field is used even though the audio signal is obtained using the built-in microphones in the camcorder, the null is not appropriately formed as shown in FIG. 3B, for example. On the other hand, if an array manifold vector that contains the influence of the housing of the camcorder is used, the direction of the coughing can be accurately estimated to be −40° from the null direction of the average beam pattern as shown in FIG. 3C, for example.

FIG. 4D shows a result of deeming −90° indicated by a vertical dotted line in FIG. 3B to be a provisional null direction and orienting the null to this direction with the fixed beamformer. However, the direction (−90°) to which the null is oriented is shifted from the direction (−40°) of the coughing, and therefore the sound of the coughing has not been effectively removed. On the other hand, FIG. 4E shows a result of orienting the null to −40° indicated by the vertical dotted line in FIG. 3C with the fixed beamformer. Since the direction to which the null is oriented coincides with the direction of the coughing, the sound of the coughing has been effectively removed.

As described above, the accuracy of the estimation of the sound source direction significantly affects the noise removing performance. Furthermore, in addition to the sound source direction estimation, calculation of the filter coefficient of the aforementioned fixed beamformer requires the array manifold vector in the direction to which the null is oriented. For this reason, the appropriateness of the selection of the array manifold vector also affects the calculation of the filter coefficient of the fixed beamformer. Accordingly, in audio processing such as noise removal, it is important to select an array manifold vector appropriate for the environment at the time of acquiring sound using microphone elements, such as the shape of a housing. In view of the above, the present embodiment will disclose a signal processing apparatus capable of selecting and using an array manifold vector corresponding to the state at the time of obtaining the audio signal which significantly changes due to the influence of a housing in audio processing such as noise removal.

FIG. 1 is a block diagram showing an exemplary configuration of a video camera (camcorder) according to the embodiment. A signal processing apparatus 100 includes a system control unit 101 that governs all constituent elements, a storage unit 102 that stores various data, and a signal analyzing unit 103 that performs signal analysis processing.

The video camera includes a built-in microphone 111 and an audio signal input unit 112 as elements for achieving a function of a sound acquisition system. Any external microphone 119 can also be connected to the signal processing apparatus 100. In the present embodiment, the built-in microphone 111 and the external microphone 119 are each constituted by a 2ch stereo microphone in which two microphone elements are arranged at an interval. Note that the number of microphone elements need only be more than one, and may also be three or more. That is to say, the present invention is not limited to the case where the number of microphone elements is two.

The audio signal input unit 112 detects connection of the external microphone 119, and if the external microphone 119 is connected, the audio signal input unit 112 inputs the audio signal not from the built-in microphone 111 but from the external microphone 119. The audio signal input unit 112 also performs amplification and AD conversion on an analog audio signal from each microphone element in the built-in microphone 111 or the external microphone 119, and generates a 2ch microphone signal, which is a digital audio signal, at a cycle corresponding to a predetermined audio sampling rate.

The video camera includes a lens unit 120 and a video signal input unit 124 as elements for achieving a function of an image capturing system. The lens unit 120 further includes an optical lens 121, a lens control unit 122, and an in-lens storage unit 123. The lens unit 120 performs photoelectric conversion on light entering the optical lens 121, and generates an analog video signal. The video signal input unit 124 performs AD conversion and gain adjustment on an analog video signal from the lens unit 120, and generates a digital video signal at a cycle corresponding to a predetermined video frame rate. The lens control unit 122 communicates with the system control unit 101 to perform control for driving the optical lens 121 and exchange information regarding the lens unit 120. The in-lens storage unit 123 stores information regarding the lens unit 120. In the present embodiment, the lens unit 120 is constituted by an interchangeable lens that is interchangeable and whose lens housing extends and contracts in accordance with a zoom ratio. The video camera in the present embodiment also includes an input/output UI unit 131 as an element for accepting a user operation and presenting an operation menu, a video signal, and the like to a user. The input/output UI unit 131 is constituted by a touch panel, for example.

A detailed description will be given below of audio signal processing performed by the video camera (signal processing apparatus 100) in the present embodiment having the above-described configuration. Initially, prior to the shooting by the signal processing apparatus 100, various array manifold vectors to be used in audio processing at the time of the shooting are obtained.

Upon the external microphone 119 being connected when shooting is not performed, the connection is detected by the audio signal input unit 112. This detection is communicated from the audio signal input unit 112 to the system control unit 101. Next, the input/output UI unit 131 prompts the user to input an external microphone interval, which is an interval between the microphone elements in the external microphone 119, in accordance with an instruction from the system control unit 101. The value input in millimeters, for example, by the user is set as the external microphone interval of the external microphone 119 and stored in the storage unit 102. If the microphone interval is known, an array manifold vector can be generated by a theoretical formula in a free field. If the user does not know the external microphone interval, it should be noted that the external microphone interval may be left unset.

The signal processing apparatus 100 also stores, in the storage unit 102, a transfer function, in which the way sound propagates within the housing is considered, for a sound source in each direction of each microphone element in the built-in microphone 111. The signal processing apparatus 100 may obtain an array manifold vector, in which the way sound propagates within the housing is considered, of each microphone element in the built-in microphone 111 from the outside by means of communication.

For example, upon the lens unit 120 being attached through interchange of the lens when shooting is not performed, this attachment is detected by the system control unit 101. Next, the system control unit 101 communicates with the lens control unit 122 in the lens unit 120 and identifies the type of the currently attached lens unit 120. Furthermore, the system control unit 101 obtains, via the lens control unit 122, an array manifold vector for the signal processing apparatus 100 from among a plurality of array manifold vectors stored in the in-lens storage unit 123, and saves the obtained array manifold vector in the storage unit 102. The array manifold vector for the signal processing apparatus 100 is an array manifold vector in the case where the audio signal is obtained by the built-in microphone 111 in the signal processing apparatus 100 in a state where the lens unit 120 is attached to the signal processing apparatus 100. Note that the plurality of array manifold vectors are stored in the in-lens storage unit 123 in order to deal with a plurality of types of video cameras having different housing shapes.

In general, there are various types of interchangeable lenses having different focal lengths, f-numbers, and the like, and the shape of the lens housing is different for each type. For this reason, the lens unit 120 being attached to the signal processing apparatus 100 means a change of the housing shape of the signal processing apparatus 100 for each type of the lens unit 120, and it is therefore conceivable that the array manifold vector also changes for each type of the lens unit 120. Furthermore, in the case where the lens is a zoom lens, the shape of the lens housing extends and contracts in accordance with the zoom ratio. This means a change of the housing shape of the video camera (signal processing apparatus 100) in accordance with the zoom ratio, and it is therefore conceivable that the array manifold vector also changes in accordance with the zoom ratio of the lens unit 120. Accordingly, if the lens unit 120 is a zoom lens, the system control unit 101 obtains the array manifold vector for each zoom ratio and saves the obtained array manifold vector in the storage unit 102.

Thus, various array manifold vectors obtained from the lens unit 120 are saved in the storage unit 102 in association with the type of the interchangeable lens (type of the lens unit 120) and the zoom ratio thereof. Note that array manifold vectors corresponding to a lens attached to the signal processing apparatus 100 by default, a representative interchangeable lens that may possibly be attached to the signal processing apparatus 100, a state where a lens is not attached, and the like may be stored in advance in the storage unit 102.

Note that the array manifold vector which contains the influence of the housing of the signal processing apparatus 100 can be measured using the built-in microphone 111 for each type and zoom ratio of the lens unit 120 by means of a traverse apparatus in an anechoic chamber. Alternatively, an array manifold vector may be generated based on CAD data by simulation taking the wave nature into account, such as a finite-element method or a boundary element method.

Although the array manifold vector, which is a transfer function for each direction, is data of a frequency region, it should be noted that the array manifold vector may be stored in the form of an impulse response for each direction to serve as the origin of the array manifold vector, in the in-lens storage unit 123 in the lens unit 120. When taking the impulse response for each direction into the storage unit 102, Fourier transformation may be performed by the signal analyzing unit 103 in accordance with a frequency resolution in the audio processing performed by the signal processing apparatus 100, and the obtained array manifold vector may be saved in the storage unit 102.

Next, a shooting operation performed by the signal processing apparatus 100 will be described. A video signal taken by the image capturing system is projected on a screen of the input/output UI unit 131 in real time. At this time, a designated value of the zoom ratio is communicated to the system control unit 101 by moving a tab of a slider bar on the screen indicating the zoom ratio. The lens control unit 122 then performs control for driving the optical lens 121 in accordance with an instruction from the system control unit 101, and performs optical zoom processing in accordance with the designated zoom ratio.

When in a situation in which the user wants to start shooting, the user touches and selects "REC" in a menu displayed on the input/output UI unit 131. The signal processing apparatus 100 starts, in accordance with this selection, to record the video signal taken by the image capturing system and the audio signal taken by the sound acquisition system, in the storage unit 102. A 2ch microphone signal, which is the audio signal obtained by the sound acquisition system, is sequentially recorded in the storage unit 102, and sound source direction estimation processing and noise removal processing, which are the audio processing in the present embodiment, are performed in accordance with a flowchart in FIG. 5. Note that the description will be given, assuming an audio sampling rate of 48 kHz.

A signal sampling unit with which a microphone signal is filtered in the beamformer will be called a time block, and the length of the time block is a length of 1024 samples (approx. 21 ms) in the present embodiment. A microphone signal is filtered within a time block loop while shifting a signal sampling range by 512 samples (approx. 11 ms), which is half the aforementioned time block length. That is to say, a first sample to a 1024th sample of a microphone signal are filtered in the first time block, and a 513th sample to a 1536th sample are filtered in the second time block. It is assumed that the flowchart in FIG. 5 shows processing in one time block within a time block loop.

In step S501, the system control unit 101 communicates with the audio signal input unit 112 and checks whether the external microphone 119 is connected. If the external microphone 119 is connected, i.e., if the audio signal is obtained by the external microphone 119, the processing proceeds to step S502. In step S502, the system control unit 101 checks whether the external microphone interval of the external microphone 119 is set, and if the external microphone interval is set, the processing proceeds to step S503.

In step S503, the signal analyzing unit 103 generates an array manifold vector with the set external microphone interval as a parameter. The generated array manifold vector is selected as an array manifold vector to be used in processing of the audio signal in a time block that is currently obtained by the external microphone 119. Since the external microphone 119 is separate from the signal processing apparatus 100, it is conceivable that the external microphone 119 is not easily affected by the housing of the signal processing apparatus 100. Accordingly, an array manifold vector $a(f, \theta)$ is generated by a theoretical formula in a free field expressed by Equation (1) below and the external microphone interval, and is selected for later audio processing.

$$a(f, \theta)=exp(-j2f\tau(\theta, d)) \quad (1)$$

Here, j denotes an imaginary unit, and f denotes a frequency. Also consider a unit sphere whose center is the center between the two microphone elements in the external microphone 119. Then, a delay time of propagation from a point at an azimuth θ on the unit sphere to each microphone element is $\tau_i(\theta, d)$ (i=1, 2), which is a function of the azimuth θ and the external microphone interval d, and this function is collectively put as vector $\tau(\theta)=[\tau_1(\theta)\ \tau_2(\theta)]^T$. Here, a superscript "T" denotes transposition. Note that it is assumed that the front (θ=0°), which is the shooting direction of the signal processing apparatus 100, is in the direction of a perpendicular bisector of a line connecting the two external microphone elements.

On the other hand, if, in step S501, the external microphone 119 is not connected, i.e., if the audio signal is obtained by the built-in microphone 111, the processing proceeds to step S504. In step S504, the system control unit 101 communicates with the lens control unit 122 in the lens unit 120, and obtains the type of the lens unit 120 and the current zoom ratio. In step S505, the system control unit 101 checks whether the storage unit 102 stores the array manifold vector corresponding to the type of the lens unit 120 obtained in step S504, and if so, the processing proceeds to step S506.

In step S506, the signal analyzing unit 103 selects an array manifold vector to be used in the processing of the audio signal in the current time block that is obtained by the built-in microphone 111. That is to say, an array manifold vector a(f, θ) corresponding to the type and the current zoom ratio of the lens unit 120 that are obtained in step S504 is selected. Here again, it is assumed that the front) (θ=0°), which is the shooting direction of the signal processing apparatus 100, is in the direction of a perpendicular bisector of a line connecting the two built-in microphone elements.

Note that, regarding the zoom ratio, the array manifold vector that perfectly coincides with the current zoom ratio does not always exist. Accordingly, in the present embodiment, an array manifold vector corresponding to a zoom ratio that is closest to the current zoom ratio is to be selected. Alternatively, an array manifold vector corresponding to the current zoom ratio (e.g., 2.5 times) may be generated and selected by interpolating array manifold vectors corresponding to a plurality of zoom ratios (e.g., 2 times and 3 times) on the amplitude and the phase. If the lens is being interchanged and the lens unit 120 is not attached to the signal processing apparatus 100, it should be noted that the array manifold vector corresponding to the state where the lens is not attached may be selected.

Figure 6:
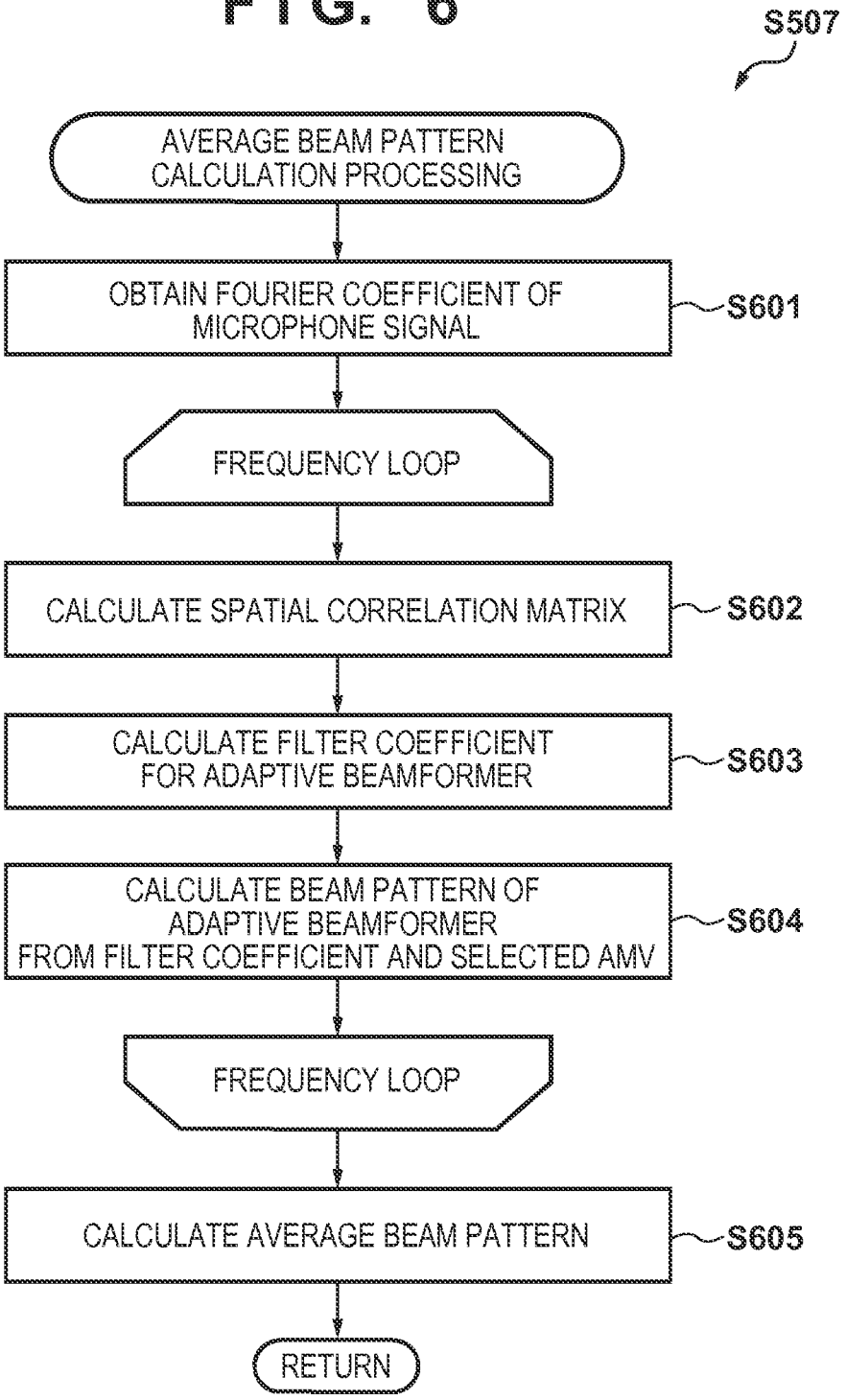
FIG. 6 is a flowchart illustrating average beam pattern calculation processing according to an embodiment.

After finishing the processing in step S503 or S506 as above, the processing proceeds to step S507. The processing in step S507 and subsequent steps are performed mainly by the signal analyzing unit 103. In step S507, the signal analyzing unit 103 performs average beam pattern calculation processing. The average beam pattern calculation processing will now be described in detail with reference to a flowchart in FIG. 6.

In step S601, the signal analyzing unit 103 performs Fourier transformation on the 2ch microphone signal in the current time block and obtains a Fourier coefficient, which is a complex number. At this time, a time resolution and a frequency resolution in the Fourier transformation are determined by the time block length. A spatial correlation matrix is calculated in next step S602, and since the calculation of a spatial correlation matrix, which is a statistic, requires average processing, a unit called a time frame is introduced with the current time block as a reference.

It is assumed that the time frame length is a length of 1024 samples, which is the same as the time block length, and the time frame is a signal sampling range obtained by shifting the signal sampling range for the current time block serving as a reference by a predetermined time frame shift length. In the present embodiment, it is assumed that the time frame shift length is a length of 32 samples, and the number of time frames corresponding to the number of times of the aforementioned averaging is 128. That is to say, in the first time block, a first time frame targets a first sample to a 1024th sample of a microphone signal as the first time block does, and a second time frame targets a 33rd sample to a 1056th sample. Thus, a 128th time frame targets a 4065th sample to a 5088th sample, and accordingly the spatial correlation matrix in the first time block is calculated from a 106-ms microphone signal from the first sample to the 5088th sample. Note that the time frame may be a signal sampling range prior to the current time block.

In view of the above, in step S601, the Fourier coefficient at the frequency f in the time frame k regarding the current time block of a microphone signal on an ith channel is obtained as $Z_i(f, k)$ (i=1, 2, k=1 to 128). Note that it is preferable to window the microphone signal before the Fourier transformation, and the windowing is also performed after returning the signal to a time signal again by inverse Fourier transformation. For this reason, a sine window or the like is used as a window function for time blocks that overlap each other by 50%, considering a reconstruction condition in two times of windowing.

Steps S602 to S604 are processing for each frequency, and are performed within a frequency loop. In step S602, the signal analyzing unit 103 calculates the spatial correlation matrix, which is a statistic indicating a spatial characteristic of the microphone signal. Initially, the Fourier coefficients for respective channels obtained in step S601 are collectively vectorized and put as $z(f, k)=[Z_1(f, k)\ Z_2(f, k)]^T$. A matrix $R_k(f)$ at the frequency f in the time frame k is defined using z(f, k) as Equation (2). Here, a superscript "H" denotes complex conjugate transposition.

$$R_k(f)=z(f, k)z^H(f, k) \tag{2}$$

Note that the spatial correlation matrix R(f) is obtained by averaging $R_k(f)$ with respect to all time frames, i.e., by adding $R_1(f)$ to $R_{128}(f)$ and dividing the resulting value by 128.

In step S603, the signal analyzing unit 103 calculates the filter coefficient of the adaptive beamformer. The filter coefficient for filtering the microphone signal on the ith channel is put as $W_i(f)$ (i=1, 2), and a filter coefficient vector of the beamformer is put as $w(f)=[W_1(f)\ W_2(f)]^T$. Here, the signal analyzing unit 103 calculates the filter coefficient of the adaptive beamformer by the minimum norm method. This is based on a rule of output power minimization, and a constraint for setting w(f) to a non-zero vector is described by designating a filter coefficient norm. Since average output power of the beamformer at the frequency k is expressed by $w^H(f)R(f)w(f)$, the filter coefficient of the adaptive beamformer based on the minimum norm method is obtained as a solution of a constrained optimization problem of Equation (3).

$$\min_w w^H(f)R(f)w(f) \quad \text{subject to } w^H(f)w(f)=1 \tag{3}$$

Since this is a minimization problem in a quadratic form with R(f), which is an Hermitian matrix, as a coefficient matrix, an eigenvector corresponding to a minimum eigenvalue of R(f) is a filter coefficient vector $w_{MN}(f)$ of the adaptive beamformer calculated by the minimum norm method.

In step S604, the signal analyzing unit 103 calculates the beam pattern of the adaptive beamformer using the filter coefficient $w_{MN}(f)$ of the adaptive beamformer calculated in step S603 and the array manifold vector a(f, θ) selected in the current time block. A value ψ(f, θ) in the azimuth θ direction of the beam pattern is obtained by Equation (4).

$$\psi(f, \theta)=w_{MN}^H(f)a(f, \theta) \tag{4}$$

A horizontal beam pattern is obtained by calculating ψ(f, θ) while changing θ in a(f, θ) from −180° to 180° at 1° intervals, for example. Note that, in order to suppress the amount of calculation, only a beam pattern from −90° to 90° through 0° may be calculated, paying attention to the symmetricity of the beam pattern. Also, the vicinity of the null that is important for finding the sound source direction may be more accurately grasped by making the intervals of θ small only in the vicinity of the null where ψ is small.

In step S605, the beam patterns at the respective frequencies calculated in step S604 are averaged to calculate the average beam pattern. Note that the averaging does not necessarily need to be performed for all frequencies, and for example, the averaging may be performed only for frequencies in a principal frequency band of target sound. The average beam pattern calculation processing in step S507 ends here.

On the other hand, if, in step S502, the external microphone interval of the external microphone 119 is unset, the processing proceeds to step S520. In step S520, external microphone interval estimation processing is performed. First, an idea of the external microphone interval estimation processing will be described.

Figure 7A:
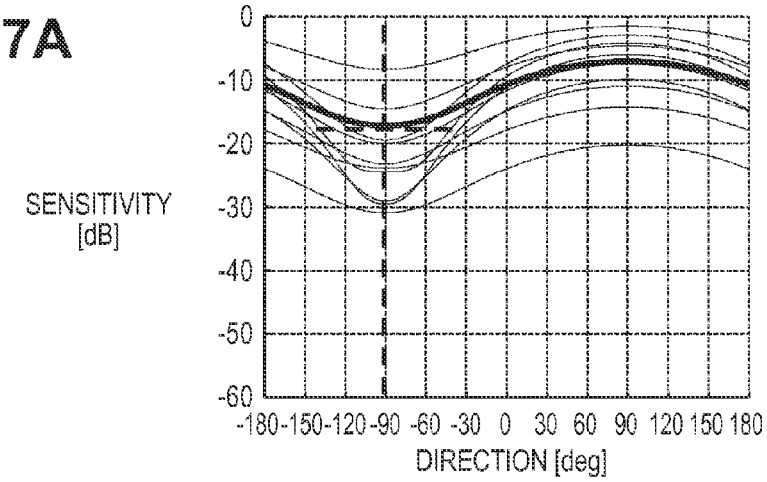
FIGS. 7A to 7E are diagrams illustrating external microphone interval estimation processing according to an embodiment.
Figure 7B:
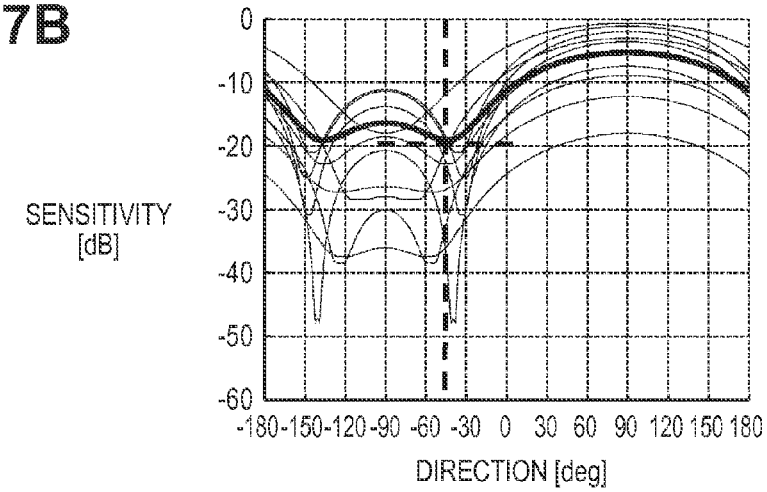
Figure 7C:
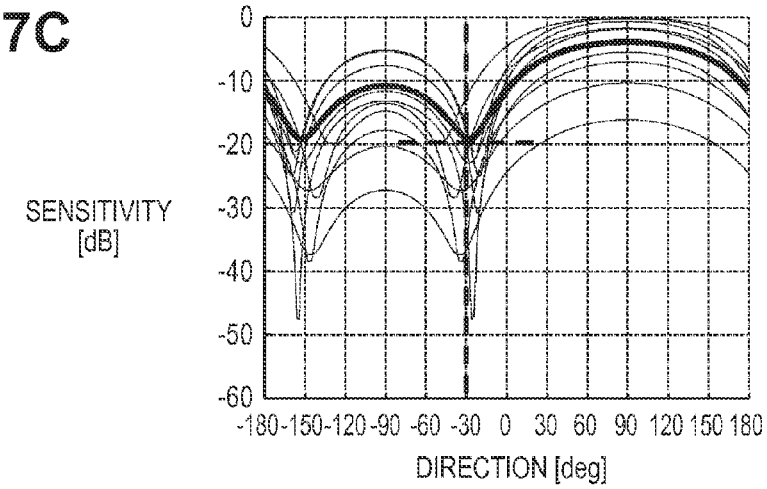
Figure 7D:
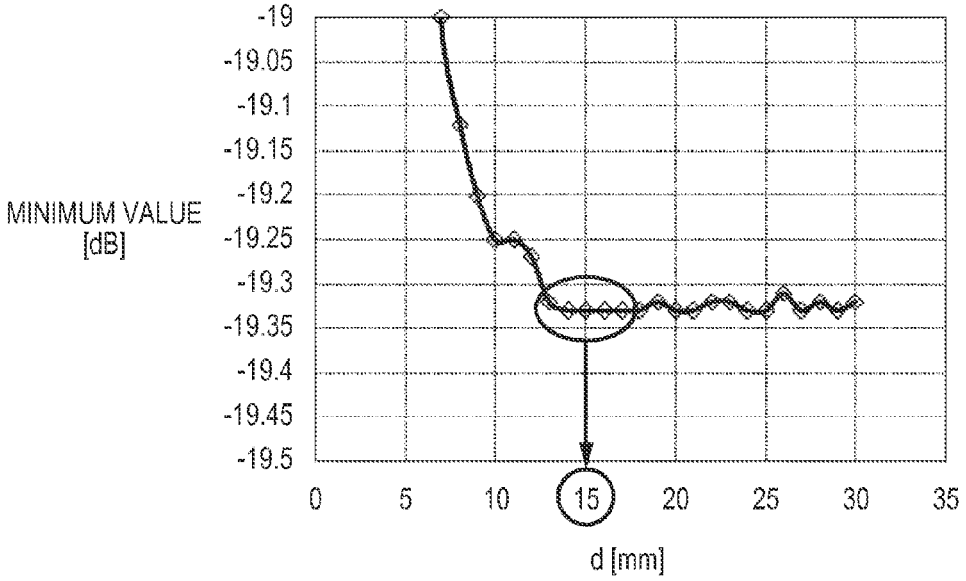
Figure 7E:
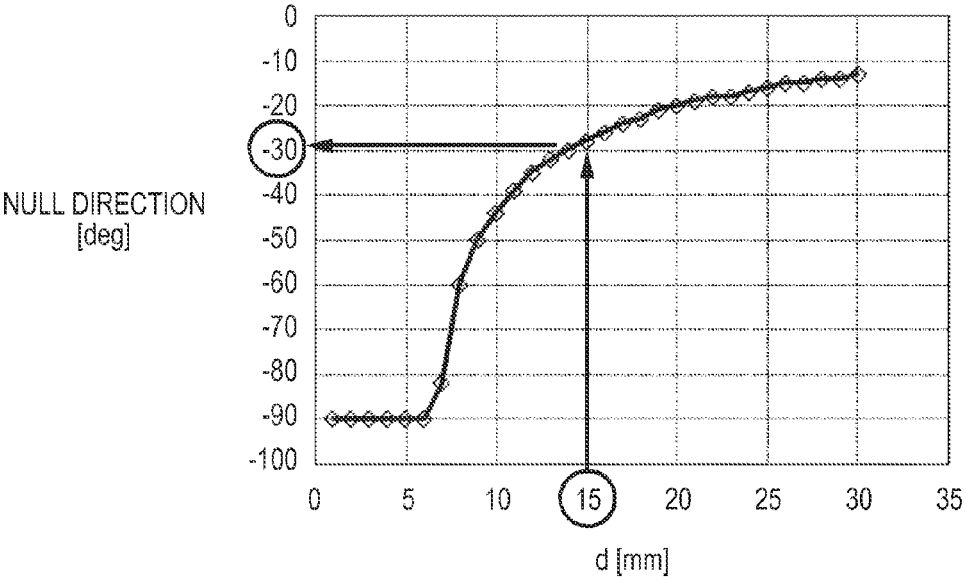

The array manifold vector is generated by the theoretical formula in a free field expressed by Equation (1) while gradually increasing the external microphone interval d, and the average beam pattern calculation processing is performed. As shown in FIGS. 7A to 7C, it is found that, as the external microphone interval is increased from 5 mm in FIG. 7A to 10 mm in FIG. 7B and to 15 mm in FIG. 7C, the minimum value of the average beam pattern indicated by horizontal dotted lines becomes smaller, and the null direction indicated by vertical dotted lines also changes. Graphs of a relationship therebetween are shown in FIGS. 7D and 7E. In this case, the correct external microphone interval is 15 mm and the correct sound source direction is −30°, and it is found from FIG. 7D that the minimum value of the average beam pattern tends to bottom out and converge when d mostly reaches its correct value. By setting d at the time of this convergence as the external microphone interval, the sound source direction can be accurately estimated from the null direction at this time, as shown in FIG. 7E.

Figure 8:
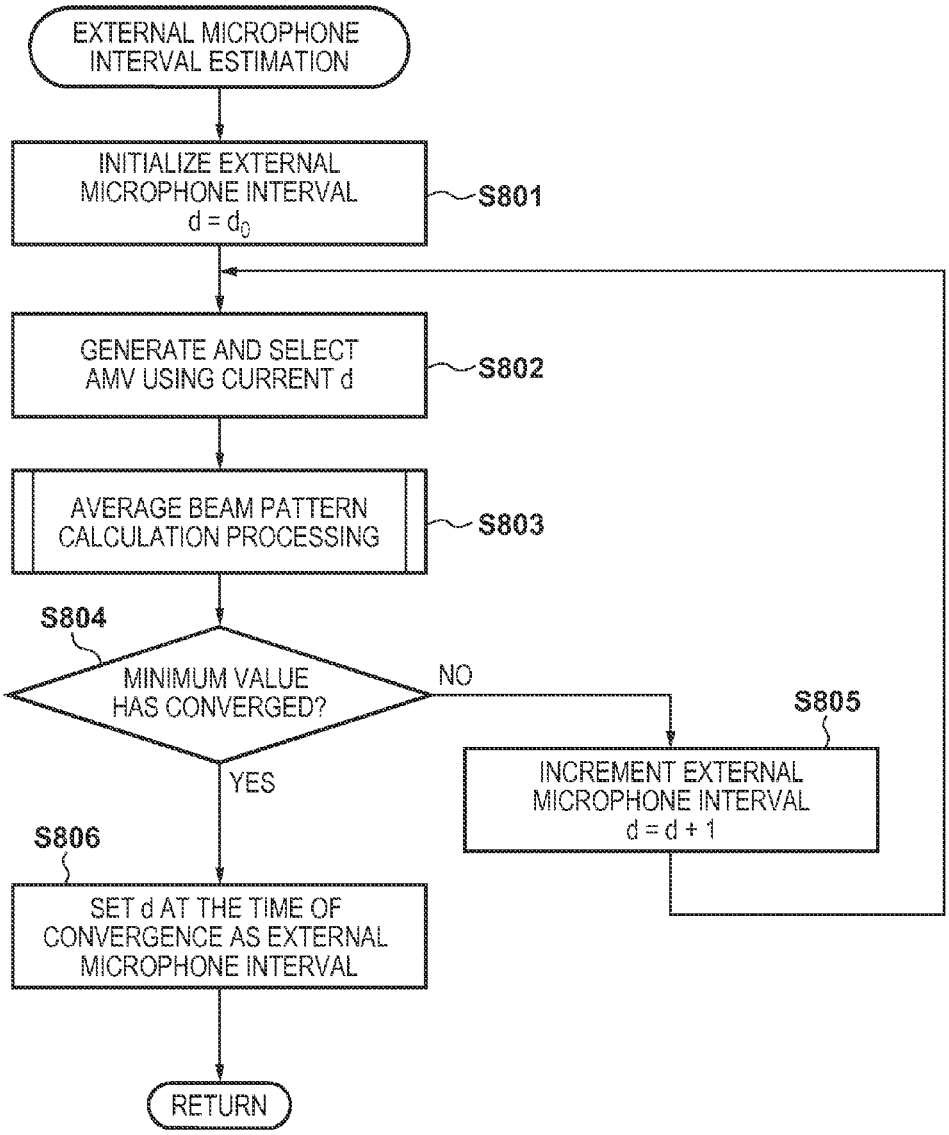
FIG. 8 is a flowchart of the external microphone interval estimation processing according to an embodiment.

The external microphone interval estimation processing (S520) that is based on the above-described idea will be described with reference to a flowchart in FIG. 8. In step S801, the signal analyzing unit 103 initializes the external microphone interval as $d=d_0$ (e.g., 1 mm). In step S802, the signal analyzing unit 103 generates the array manifold vector by the theoretical formula in a free field expressed by Equation (1) using current d as a parameter, and selects the generated array manifold vector as the array manifold vector to be used in the next step.

In step S803, the average beam pattern calculation processing is performed using the array manifold vector selected in step S802. The average beam pattern calculation processing is as described above using the flowchart in FIG. 6. Note that, in the average beam pattern calculation processing in step S803 illustrated by the flowchart in FIG. 6, the processing in steps S601 to S603 need only be performed only at the time of initial $d=d_0$. In the case where the external microphone interval estimation processing (S520) is executed, the average beam pattern calculation processing is performed within the external microphone interval estimation processing, and accordingly the average beam pattern calculation processing in step S507 can be omitted.

In step S804, it is determined whether the minimum value of the average beam pattern calculated in step S803 has converged, and if not, the processing proceeds to step S805. For example, if, in step S803, the minimum values of n+1 average beam patterns with d=t−n to d=t (t is the value of current d, n≥1) are within a predetermined range, the signal analyzing unit 103 determines that the minimum value of the average beam pattern has converged. If it is determined that the minimum value of the average beam pattern has not converged, the processing proceeds to step S805, the signal analyzing unit 103 increments the external microphone interval as d=d+1, and returns the processing to step S802. If it is determined in step S804 that the minimum value of the average beam pattern has converged, the processing proceeds to step S806. In step S806, the signal analyzing unit 103 sets d at the time when the minimum value of the average beam pattern has converged as the external microphone interval of the external microphone 119.

Returning to FIG. 5, if, in step S505, an array manifold vector corresponding to the type of the lens unit 120 is not stored, the processing proceeds to step S530. In step S530, the signal analyzing unit 103 performs processing for selecting a substitute array manifold vector. If an array manifold vector is used that corresponds to a lens with a lens housing shape that is totally different from that of the lens unit 120, beam patterns such as those in FIG. 3B are obtained, and the null of the average beam pattern is not appropriately formed and becomes shallow and spread. On the other hand, if an array manifold vector is used that corresponds to a lens with a lens housing shape which is relatively close to that of the lens unit 120, it is conceivable that the null of the average beam pattern becomes deep as shown in FIG. 3C. For this reason, in the case where the array manifold vector corresponding to the type of the lens unit 120 is not stored, an array manifold vector to be used instead is determined from the depth of the null of the average beam pattern.

Substitute array manifold vector selection processing (S530) that is based on the above-described idea will be described with reference to a flowchart in FIG. 9. Steps S901 to S903 are processing for each array manifold vector stored in the storage unit 102, and is performed within an array manifold vector loop.

In step S901, the array manifold vector to be a target in a processing loop (AMV loop) is selected. In step S902, the signal analyzing unit 103 performs the average beam pattern calculation processing using the array manifold vector selected in step S901. The average beam pattern calculation processing is as described using the flowchart in FIG. 6. However, in the average beam pattern calculation processing executed in step S902, steps S601 to S603 need only be performed only at the first time in the AMV loop. In the case where the substitute array manifold vector selection processing (S530) is executed, the average beam pattern calculation processing is performed within the substitute array manifold vector selection processing, and accordingly the average beam pattern calculation processing in step S507 can be omitted.

In step S903, the signal analyzing unit 103 calculates the depth of the null of the average beam pattern calculated in step S902. The depth of the null may be a difference between the largest value and the minimum value of the average beam pattern as indicated by a double arrow in FIG. 3C, and more simply, the depth of the null may be considered based only on the minimum value. In step S904, the signal analyzing unit 103 selects the array manifold vector at the time when the null is deepest as the substitute array manifold vector based on the depth of the null calculated in step S903.

Figure 9:
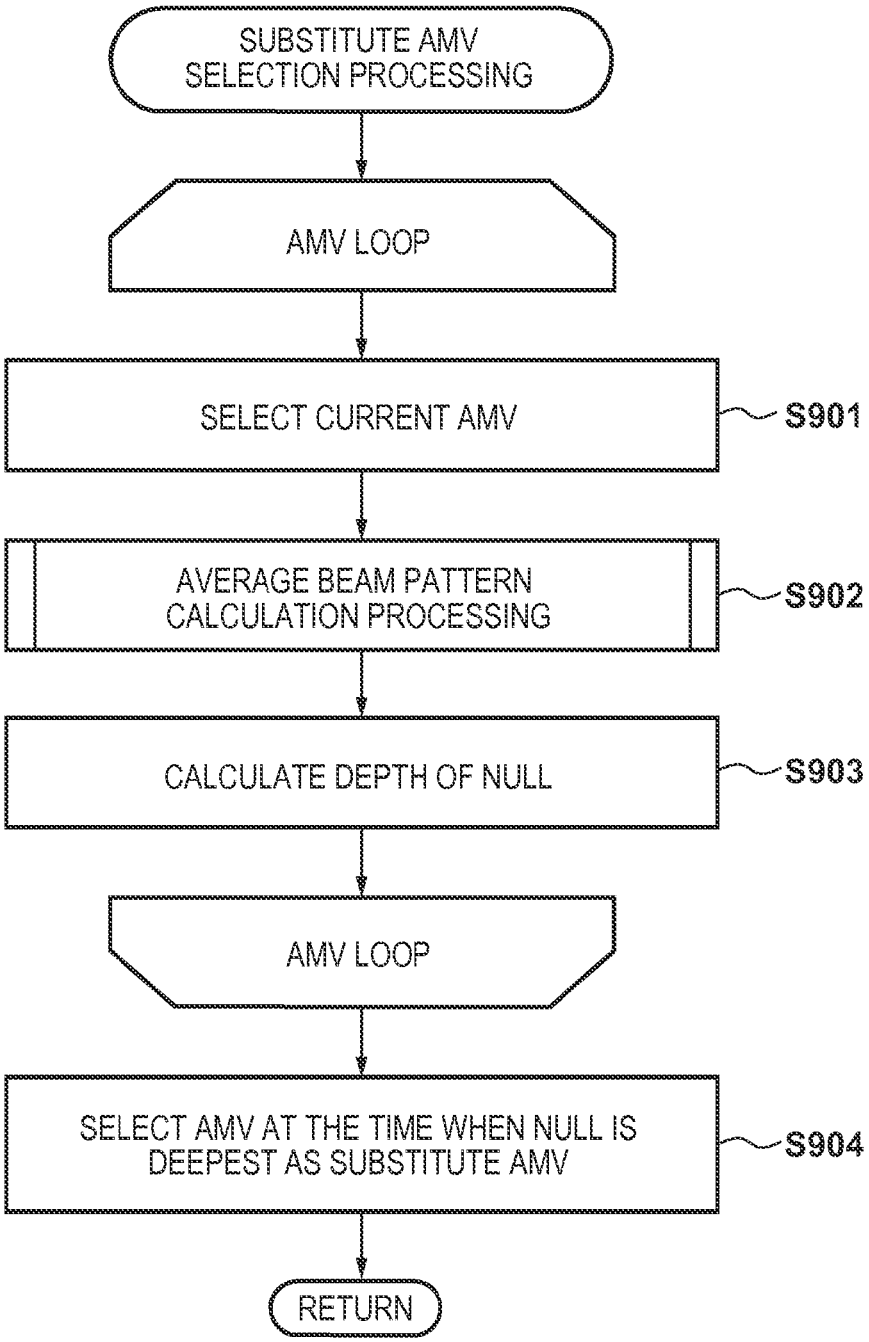
FIG. 9 is a flowchart of substitute array manifold vector selection processing according to an embodiment.

Note that not all array manifold vectors stored in the storage unit 102 necessarily have to be the targets in the AMV loop shown in FIG. 9. For example, only an array manifold vector corresponding to a lens with a focal length that is close to that of the lens unit 120 and a lens housing shape considered to be close to that of the lens unit 120 may be a processing target in the AMV loop. Regarding the zoom ratio as well, only an array manifold vector corresponding to a zoom ratio that is close to the current zoom ratio may be a target in the AMV loop. Furthermore, a configuration may be employed in which the AMV loop is finished when the null depth reaches a predetermined value (e.g., 10 dB) or larger, and the array manifold vector at this time is selected as the substitute array manifold vector.

Returning to the flowchart in FIG. 5, in step S508, the signal analyzing unit 103 estimates the sound source direction from the null direction of the average beam pattern calculated in the average beam pattern calculation processing (S507, S803, S902). That is to say, the null direction $\theta_{null}$ is determined from a point at which the average beam pattern takes a minimum value, or more simply a minimum value, and is set as the estimated sound source direction.

In the present embodiment, an appropriate array manifold vector is selected for each time block in accordance with a change of the influence of the housing due to switching between the built-in microphone 111 and the external microphone 119, and a change of the housing shape due to the type and the zoom ratio of the lens unit 120. For this reason, the null of the average beam pattern is appropriately formed in the sound source direction regardless of the existence of the influence of the housing shape change or the like, as shown in FIGS. 3A and 3C, and the sound source direction can be estimated with high accuracy.

In the case where the number of microphone elements is two, it should be noted that if an array manifold vector obtained by the theoretical formula in a free field is used, there is a possibility that sound source directions with which distances (propagation delay time) to the two microphone elements are the same cannot be distinguished. This is because, regarding beam patterns using the array manifold vector obtained by the theoretical formula in a free field, a beam pattern from −90° to 90° through 0° and a beam pattern from −90° to 90° through ±180° are symmetric. That is to say, the same null is formed at −30° and −150°, which are in a symmetric position relationship as shown in FIG. 3A.

However, if an array manifold vector that contains the influence of the housing is used in the case of using the built-in microphone as in the present embodiment, the influence of the housing in respective directions does not always form a symmetric shape, and therefore the nulls formed at −40° and −140° that are in a symmetric position relationship are different as shown in FIG. 3C. Furthermore, since it is conceivable that −40° at which the depth of the null is deeper is the correct sound source direction, even if the number of microphone elements is two, the sound source direction can be uniquely specified.

In the case of obtaining the audio signal using the external microphone 119 that have only two microphone elements, it should be noted that the sound source direction may be estimated using the video signal obtained by the video signal input unit 124. For example, if the average beam pattern obtained in step S507 has a symmetric shape in the case of the external microphone 119 that have only two microphone elements, the signal processing apparatus 100 analyzes the video in a direction in a shooting range among directions in which the null is formed. With this analysis, if it can be recognized by the video analysis that an object exists in one of the directions in which the null is formed in the average beam pattern, this null may be set as the sound source direction. If an object does not exist in the null direction in the shooting range, the null in the other direction may be set as the sound source direction.

In the case where the number of microphone elements in the external microphone 119 is three or more, it should be noted that it is more likely to be able to uniquely specify the sound source direction since, as the number of microphone elements increases, it is more unlikely that distances in a plurality of directions are the same. Accordingly, in the case where the number of microphone elements in the external microphone 119 is only two, the sound source direction may be estimated using the audio signal obtained by the built-in microphone 111 together.

In this case, a configuration may be employed in which the signal processing apparatus 100 adds the audio signal obtained by the external microphone 119 to the video signal to be stored in the storage unit 102 and stores this audio signal, and does not add the audio signal obtained by the built-in microphone 111 to the video signal and uses this audio signal only in the estimation of the sound source direction.

Also, even in the case where the obtaining of the audio signal by the built-in microphone 111 is set, the signal processing apparatus 100 may estimate the sound source direction using the audio signals obtained by the built-in microphone 111 and the external microphone 119.

In this case, a configuration may be employed in which the signal processing apparatus 100 adds the audio signal obtained by the built-in microphone 111 to the video signal to be stored in the storage unit 102 and stores this audio signal, and does not add the audio signal obtained by the external microphone 119 to the video signal and use this audio signal only in the estimation of the sound source direction.

In the above-described sound source direction estimation, the filter coefficient of the adaptive beamformer is calculated by the minimum norm method using Equation (3). However, it should be noted that the present invention is not limited thereto, and for example, a minimum variance method (Capon method) or the like may be used. The minimum variance method is also a method that is based on a rule of output power minimization as in the case of the minimum norm method, whereas a main lobe direction $\theta_{main}$ is suitably designated as a constraint for setting the filter coefficient vector to a non-zero vector. The filter coefficient $w_{MV}(f)$ of the adaptive beamformer based on the minimum variance method is obtained as Equation (5).

$$w_{MV}(f, t) = \frac{R^{-1}(f)a(f, \theta_{main})}{a^H(f, \theta_{main})R^{-1}(f)a(f, \theta_{main})} \tag{5}$$

Although the sound source direction is estimated from a beam pattern $\psi(f, \theta)$ that forms a dip (null) of sensitivity in the sound source direction indicated by Equation (4) in the above description, a spatial spectrum $P(f, \theta)$ that forms a peak of sensitivity in the sound source direction may be used instead. For example, a spatial spectrum $P_{MN}(f, \theta)$ in the case of using the minimum norm method is obtained by Equation (6).

$$P_{MN}(f, \theta) = \frac{a^H(f, \theta)a(f, \theta)}{|w_{MN}^H(f)a(f, \theta)|^2} \tag{6}$$

In the minimum norm method, an eigenvector corresponding to a minimum eigenvalue of the spatial correlation matrix is used. Furthermore, a spatial spectrum $P_{MU}(f, \theta)$ based on a MUSIC method is obtained by Equation (7) by putting $E_n$ as a matrix in which all eigenvectors belonging to a noise subspace are arranged and considering orthogonality with array manifold vectors belonging to a signal subspace.

$$P_{MU}(f,\theta)=\frac{a^H(f,\theta)a(f,\theta)}{a^H(f,\theta)E_nE_n^Ha(f,\theta)} \tag{7}$$

A spatial spectrum $P_{MV}(f, \theta)$ in the case of using the minimum variance method is obtained by Equation (8).

$$P_{MV}(f,\theta)=\frac{1}{a^H(f,\theta)R^{-1}(f)a(f,\theta)} \tag{8}$$

As described above, the sound source direction estimation in the present embodiment is for calculating a sensitivity curve such as a beam pattern or a spatial spectrum having an extreme value of sensitivity in a sound source direction, using an array manifold vector and a spatial correlation matrix of the audio signal, and estimating the sound source direction from an extreme value point of the sensitivity curve.

Returning to FIG. 5, in step S509, the signal analyzing unit 103 checks whether the estimated sound source direction estimated in step S508 is out of a range of the target sound. If the estimated sound source direction is out of the range of the target sound, noise existing in the estimated sound source direction is deemed to be dominant in the current time block, and the processing proceeds to noise removal processing in steps S510 and S511. On the other hand, if, in step S509, the estimated sound source direction is not out of the range of the target sound, i.e., is within the range of the target sound, the target sound existing in the estimated sound source direction is deemed to be dominant in the current time block, and the processing skips the noise removal processing in steps S510 and S511 and proceeds to step S512. Note that the range of the target sound may be determined to be, for example, ±30° with respect to the front, which is the shooting direction of the signal processing apparatus 100, or may be the range of the angle of view of the image capturing system that changes in accordance with the current zoom ratio. Also, the user may set the range of the target sound via the input/output UI unit 131. The noise removal processing will be described below.

Processing in steps S510 and S511 is processing for each frequency, and is performed within a frequency loop. In step S510, the signal analyzing unit 103 calculates a filter coefficient $w_{fix}(f)$ of the fixed beamformer for forming a sharp null in the estimated sound source direction $\theta_{null}$ estimated in step S508. Regarding a beam pattern of the fixed beamformer, a condition under which the null is formed in the estimated sound source direction $\theta_{null}$ is expressed by Equation (9) using an array manifold vector $a(f, \theta_{null})$.

$$w_{fix}^H(f)a(f,\theta_{null})=0 \tag{9}$$

However, with only Equation (9), the solution is a zero vector. Therefore, Equation (10) is added as a condition under which a main lobe is formed in a main lobe direction $\theta_{main}$. Here, the main lobe direction $\theta_{main}$ is determined to be the front 0°, which is the center of the range of the target sound.

$$w_{fix}^H(f)a(f,\theta_{main})=1 \tag{10}$$

Equation (11) is obtained by collectively expressing Equations (9) and (10) using a matrix $$A(f)=[a(f,\theta_{null})a(f,\theta_{main})].$$

$$A^H(f)w_{fix}(f)=\begin{bmatrix}0\\1\end{bmatrix} \tag{11}$$

Accordingly, by multiplying both sides of Equation (11) from the left by an inverse matrix of $A^H(f)$, the filter coefficient $w_{fix}(f)$ of the fixed beamformer is obtained as Equation (12).

$$w_{fix}(f)=(A^H(f))^{-1}\begin{bmatrix}0\\1\end{bmatrix} \tag{12}$$

Here, since the norm of $w_{fix}(f)$ is different for each frequency, the norm may be normalized so as to be 1 as in the case of $w_{MN}(f)$ in the minimum norm method. Note that A(f) is not a square matrix in the case where the number of elements of the filter coefficient vector $w_{fix}(f)$, i.e., the number of microphone elements in the sound acquisition system is different from the number of control points on the beam pattern as in Equations (9) and (10), and therefore a generalized inverse matrix is used.

In step S511, filtering is performed using the filter coefficient of the fixed beamformer calculated in step S510, and a Fourier coefficient of the microphone signal from which noise has been removed is obtained. In general, the filtering using a beamformer is performed on a microphone signal as indicated by Equation (13). Here, z(f)=z(f, 1), and Y(f) is the Fourier coefficient of a noise removal signal.

$$Y(f)=w_{fix}^H(f)z(f) \tag{13}$$

However, with this equation, the noise removal signal becomes a monaural signal. Therefore, projection back for again returning the signal to a 2ch microphone signal is performed. Specifically, $w^H_{fix}$, which is a row vector, is deemed to be a horizontal matrix, and both sides of Equation (13) are multiplied from the left by a generalized inverse matrix of $w^H_{fix}$, and a Fourier coefficient $z_{PJ}(f)$ of a 2ch microphone signal from which noise has been removed is obtained as Equation (14).

$$z_{PJ}(f)=(w_{fix}^H(f))^+Y(f)=w_{fix}(f)(w_{fix}^H(f)w_{fix}(f))^{-1}w_{fix}^H(f)z(f) \tag{14}$$

Here, the superscript "+" denotes the generalized inverse matrix.

As described above, according to the present embodiment, the sound source direction can be accurately estimated by selecting an appropriate array manifold vector. Furthermore, only noise can be removed with high accuracy using the fixed beamformer that forms a sharp null in the accurately estimated noise direction, even in the case where noise is close to target sound. Although the present embodiment has described noise cancelling, it should be noted that the accurately estimated sound source direction can also be used in sound source separation.

In step S512, inverse Fourier transformation is performed on the Fourier coefficient of the 2ch microphone signal, and a microphone signal in the current time block is obtained. This microphone signal is subjected to windowing and overlap-added to the microphone signal obtained up to the previous time block, and the obtained microphone signal is sequentially recorded in the storage unit 102. The microphone signal obtained as above can be output to the outside via a data input/output unit (not shown) that is mutually connected to the storage unit 102, or reproduced by an audio reproduction system (not shown) such as an earphone, a headphone, or a speaker.

Although only the azimuth θ is considered as the direction for the sake of simplification in the above description, it should be noted that an elevation angle cp can also be considered. That is to say, an array manifold vector a(f, θ, ϕ) is prepared as a transfer function for each of the azimuth θ and the elevation angle ϕ, and a beam pattern ψ(f, θ, ϕ) is calculated while changing not only the azimuth θ but also the elevation angle ϕ from −90° to 90°, as well as using an azimuth θ and an elevation angle ϕ of 0°. Then, any sound source directions including not only the horizontal direction but also the vertical direction can be estimated from an extreme value point of an average beam pattern.

Furthermore, a distance r can also be considered in addition to the direction. That is to say, an array manifold vector a(f, θ, ϕ, r) is prepared as a transfer function for each of the azimuth θ, the elevation angle ϕ, and the distance r, and a beam pattern ψ(f, θ, ϕ, r) is calculated while changing the distance r from 0.5 m to 5 m, for example, in addition to the azimuth θ and the elevation angle ϕ. Then, a sound source distance as well as the sound source direction can be estimated from an extreme value point of an average beam pattern.

Note that, in the audio processing, a method other than the fixed beamformer may be used in the noise removal processing. For example, a phase difference between channels of a microphone signal is obtained for each frequency, and if the obtained phase difference is in a phase difference range corresponding to the estimated sound source direction, masking processing for suppressing noise may be used. In this case as well, an array manifold vector is necessary for the calculation of the phase difference range corresponding to the estimated sound source direction, and accordingly the array manifold vector selection in the present embodiment is applicable. Note that noise in a predetermined direction may be removed only by the fixed beamformer, without performing the sound source direction estimation processing using the adaptive beamformer.

In the above description, the array manifold vector is obtained when shooting is not performed, but the obtaining may be dynamically performed as interrupt processing in the audio processing at the time of shooting.

In the above description, all audio processing is performed at the time of shooting, i.e., when obtaining the audio signal, but the present invention is not limited thereto. For example, the sound source direction estimation processing and the noise removal processing can also be performed as post-processing when shooting is not performed, by recording the audio signal together with additional information with which an array manifold vector to be selected in each time block can be specified. Examples of such additional information include external microphone connection information indicating switching between the external microphone 119 and the built-in microphone 111, the external microphone interval, the type and the zoom ratio of the lens unit 120, array manifold vector identification ID, and the like.

If the external microphone 119 includes an external microphone control unit (not shown) and an in-external microphone storage unit (not shown) in the same manner as the lens unit 120, the type of the external microphone 119 can be identified by the system control unit 101 communicating with the external microphone control unit. Furthermore, the system control unit 101 can obtain the external microphone interval via the external microphone control unit and save the obtained external microphone interval in the storage unit 102 in association with the type of the external microphone.

In the case of the external microphone, the array manifold vector obtained by the theoretical formula in a free field is selected, assuming that the external microphone is not easily affected by the housing of the signal processing apparatus 100. However, a case is also conceivable where the array manifold vector diverges from the theoretical value in a free field due to the influence of the housing of the external microphone itself. For this reason, a configuration may be employed in which an array manifold vector that contains the influence of the external microphone housing is stored in the in-external microphone storage unit, and the system control unit 101 obtains this array manifold vector via the external microphone control unit and saves the obtained array manifold vector in the storage unit 102 in association with the type of the external microphone.

The method for obtaining various array manifold vectors is not limited to the above-described methods. For example, the array manifold vectors may be obtained from any external storage unit via the data input/output unit, or may be obtained from a database in a network.

In the case where the lens unit 120 is not an interchangeable lens, and the shape of the lens housing does not expand or contract in accordance with the zoom ratio, the array manifold vector is obtained only by switching between default array manifold vectors for the external microphone and the built-in microphone. In the case where an external microphone is not connected and only the built-in microphone is used, the array manifold vector is switched only when the housing shape changes due to the type and the zoom ratio of the lens unit 120. Needless to say, these cases are also included in the present invention.

The present invention can also be configured to be able to handle not only the switching between the built-in microphone and the external microphone but also switching of the array manifold vector at the time of switching between any microphones, such as switching between built-in microphones due to a change of microphone elements to be used or the like, or switching between external microphones.

In the above description, the system control unit 101 functions as a detection unit that detects a change of the housing shape of the signal processing apparatus 100 due to the lens unit 120, and the signal analyzing unit 103 selects the array manifold vector in accordance with a result of the detection. Similarly, the following case is also included in the scope of the present invention. For example, in the case where the touch panel constituting the input/output UI unit 131 is of an openable/closable type, the housing shape of the signal processing apparatus 100 can be deemed to change in accordance with an open/close state thereof. Therefore, a configuration may be employed in which the open/close state of the touch panel is detected, and the array manifold vector is selected in accordance with a result of the detection. This idea is also applicable to a foldable mobile phone, for example.

Since the signal processing apparatus 100 may possibly be equipped with various accessories other than the lens unit 120, such as a flash, the housing shape of the signal processing apparatus 100 can be deemed to change in accordance with an attached/detached state of such accessories. Therefore, a configuration may be employed in which the attached/detached state of any accessory is detected, and the array manifold vector is selected in accordance with a result of the detection.

According to the above-described embodiment, highly accurate audio processing can be achieved by selecting the array manifold vector in accordance with switching of a microphone and a change of the housing shape.

As described above, according to the above embodiment, the array manifold vector is selected in accordance with a change of a device state, and therefore highly accurate audio processing can be achieved.

Other Embodiments

Although the embodiment has been described above in detail, the present invention can be implemented in a mode of a system, an apparatus, a method, a program, a recording medium (storage medium), or the like, for example. Specifically, the present invention may be applied to a system constituted by a plurality of devices (e.g., a host computer, an interface device, an image capturing apparatus, a web application, etc.), or may be applied to an apparatus constituted by one device.

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-159761, filed Aug. 5, 2014, which is hereby incorporated by reference herein in its entirety.

What is claimed is:

1. A signal processing apparatus that processes an audio signal comprising:

one or more processors, wherein the one or more processors function as:

a sound acquisition unit configured to acquire an audio signal of a plurality of channels from a first microphone, at least a part of the first microphone being within a housing of the signal processing apparatus;

an obtaining unit configured to obtain an audio signal of a plurality of channels from a second microphone provided outside the housing of the signal processing apparatus;

a first processing unit configured to process an audio signal using first information indicating a propagation characteristic of sound from a sound source associated with a direction of the sound source, in a case of processing an audio signal acquired by the sound acquisition unit, wherein the propagation characteristic indicated by the first information is different from a propagation characteristic in a free field, and contains influence of the housing;

a second processing unit configured to process an audio signal using second information indicating a propagation characteristic of sound associated with a direction of the sound source, in a case of processing the audio signal obtained by the obtaining unit, wherein the propagation characteristic indicated by the second information is different from the propagation characteristic indicated by the first information; and an estimation unit configured to estimate a sound source direction using an audio signal processed by the first processing unit or an audio signal processed by the second processing unit.

2. The apparatus according to claim 1, wherein the first information and the second information are array manifold vectors.

3. The apparatus according to claim 1, wherein the one or more processors further function as a selecting unit configured to select whether to process an audio signal by the first processing unit or to process an audio signal by the second processing unit.

4. The apparatus according to claim 1, wherein the second information is an array manifold vector indicating a propagation characteristic in a free field obtained by using an interval of microphone elements of the second microphone as a parameter.

5. The apparatus according to claim 4, wherein the one or more processors further function as a unit configured to obtain information indicating the interval of the microphone elements of the second microphone, and wherein the second information is obtained by using the interval indicated by the obtained information.

6. The apparatus according to claim 4, wherein the one or more processors further function as a unit configured to calculate a plurality of sensitivity curves corresponding to different array manifold vectors for different intervals of the microphone elements, and estimate an actual interval of the microphone elements based on extreme values of the plurality of sensitivity curves, and wherein the second information is obtained by using the estimated interval.

7. The apparatus according to claim 6, wherein the one or more processors calculate the plurality of sensitivity curves using both the different array manifold vectors obtained by theoretical formula in a free field and a spatial correlation matrix of the audio signal.

8. The apparatus according to claim 1, wherein the one or more processors obtain the second information from the second microphone provided outside the housing.

9. The apparatus according to claim 1, wherein the one or more processors further function as a determination unit configured to determine a shape of the housing, wherein the first information indicates a propagation characteristic corresponding to a result of the determination of the determination unit.

10. The apparatus according to claim 1, wherein the one or more processors remove or separate an audio signal corresponding to a direction estimated by the estimation unit, from an audio signal acquired by the sound acquisition unit or an audio signal obtained by the obtaining unit.

11. The apparatus according to claim 1, wherein the first processing unit calculates a plurality of sensitivity curves corresponding to a plurality of array manifold vectors, and selects one of the plurality of array manifold vectors as the first information based on extreme values of the plurality of sensitivity curves, wherein each of the plurality of sensitivity curves indicates sensitivity in each direction.

12. The apparatus according to claim 1, wherein the propagation characteristic indicated by the second information does not contain the influence of the housing.

13. A signal processing apparatus that processes an audio signal comprising:

one or more processors, wherein the one or more processors function as:

a sound acquisition unit configured to acquire an audio signal of a plurality of channels from a microphone, at least a part of the microphone being within a housing of the signal processing apparatus;

a determination unit configured to determine a shape of the housing which is variable;

a first obtaining unit configured to obtain information indicating a propagation characteristic, corresponding to the shape of the housing determined by the determination unit, of sound from a sound source associated with a direction of the sound source, wherein the propagation characteristic indicated by the information is different from a propagation characteristic in a free field, and contains influence of the housing;

a processing unit configured to process the audio signal acquired by the sound acquisition unit using the information obtained by the first obtaining unit; and an estimation unit configured to estimate a sound source direction using an audio signal processed by the processing unit.

14. The apparatus according to claim 13, wherein the one or more processors further function as a second obtaining unit configured to obtain information of a lens attached to the housing;

wherein the determination unit determines the shape of the housing including the lens, based on at least one of a type of the lens and a zoom ratio of the lens that are indicated by the information of the lens obtained by the second obtaining unit.

15. The apparatus according to claim 13, wherein the information indicating the propagation characteristic is an array manifold vector.

16. The apparatus according to claim 13, wherein the estimation unit calculates a sensitivity curve indicating sensitivity in each direction using the audio signal processed by the processing unit, and estimates the direction of the sound source based on an extreme value point of the sensitivity curve.

17. The apparatus according to claim 13, wherein the one or more processors remove or separate an audio signal corresponding to a direction estimated by the estimation unit, from an audio signal acquired by the sound acquisition unit.

18. The apparatus according to claim 13, wherein the first obtaining unit calculates a plurality of sensitivity curves corresponding to a plurality of array manifold vectors, and selects one of the plurality of array manifold vectors as the information indicating the propagation characteristic based on extreme values of the plurality of sensitivity curves, wherein each of the plurality of sensitivity curves indicates sensitivity in each direction.

19. A signal processing method for processing an audio signal comprising:

acquiring an audio signal of a plurality of channels from a first microphone, at least a part of the first microphone being within a housing of a signal processing apparatus;

obtaining an audio signal of a plurality of channels from a second microphone provided outside the housing of the signal processing apparatus;

performing a first processing of processing an audio signal using first information indicating a propagation characteristic of sound from a sound source associated with a direction of the sound source, in a case of processing the audio signal acquired from the first microphone, wherein the propagation characteristic indicated by the first information is different from a propagation characteristic in a free field, and contains influence of the housing;

performing a second processing of processing an audio signal using second information indicating a propagation characteristic of sound associated with a direction of the sound source, in a case of processing an audio signal obtained from the second microphone, wherein the propagation characteristic indicated by the second information is different from the propagation characteristic indicated by the first information; and estimating a sound source direction using an audio signal processed in the first processing or an audio signal processed in the second processing.

20. A signal processing method for processing an audio signal comprising:

acquiring an audio signal of a plurality of channels from a microphone, at least a part of the microphone being within a housing of a signal processing apparatus;

determining a shape of the housing which is variable;

obtaining information indicating a propagation characteristic, corresponding to the determined shape of the housing, of sound from a sound source associated with a direction of the sound source, wherein the propagation characteristic indicated by the information is different from a propagation characteristic in a free field, and contains influence of the housing;

processing an audio signal acquired in the sound acquiring using the obtained information; and estimating a sound source direction using the processed audio signal.

21. A non-transitory computer-readable storage medium storing a program for causing a computer to execute a signal processing method for processing an audio signal, the method comprising:

acquiring an audio signal of a plurality of channels from a first microphone, at least a part of the first microphone being within a housing of a signal processing apparatus;

obtaining an audio signal of a plurality of channels from a second microphone provided outside the housing of the signal processing apparatus;

performing a first processing of processing an audio signal using first information indicating a propagation characteristic of sound from a sound source associated with a direction of the sound source, in a case of processing the audio signal acquired from the first microphone, wherein the propagation characteristic indicated by the first information is different from a propagation characteristic in a free field, and contains influence of the housing;

performing a second processing of processing an audio signal using second information indicating a propagation characteristic of sound associated with a direction of the sound source, in a case of processing an audio signal obtained from the second microphone, wherein the propagation characteristic indicated by the second information is different from the propagation characteristic indicated by the first information; and estimating a sound source direction using an audio signal processed in the first processing or an audio signal processed in the second processing.

22. A non-transitory computer-readable storage medium storing a program for causing a computer to execute a signal processing method for processing an audio signal, the method comprising:

acquiring an audio signal of a plurality of channels from a microphone, at least a part of the microphone being within a housing of the signal processing apparatus;

determining a shape of the housing which is variable;

obtaining information indicating a propagation characteristic, corresponding to the determined shape of the housing, of sound from a sound source associated with a direction of the sound source, wherein the propagation characteristic indicated by the information is different from a propagation characteristic in a free field, and contains influence of the housing;

processing an audio signal acquired in the sound acquiring using the obtained information; and estimating a sound source direction using the processed audio signal.

* * * * *